US005740501A

United States Patent [19]

Tonomoto et al.

[11] Patent Number: 5,740,501

[45] Date of Patent: Apr. 14, 1998

[54] PHOTO-SENSITIVE DRUM FORMED FROM EXTRUDED OR DRAWN BLANK AND IMAGE RECORDING APPARATUS HAVING SAME

[75] Inventors: Yoshihiro Tonomoto; Kenji Fuke, both of Kawasaki, Japan

[73] Assignee: Fujitsu Limited, Kawasaki, Japan

[21] Appl. No.: 649,483

[22] Filed: May 17, 1996

[30] Foreign Application Priority Data

Jun. 1, 1995 [JP] Japan ..... 7-135131

[51] Int. Cl.[6] ..... G03G 15/00

[52] U.S. Cl. ..... 399/116; 399/159; 430/64

[58] Field of Search ..... 355/211, 212; 399/159, 116, 117; 430/56, 69, 135, 53; 29/895.2, 895.21

[56] References Cited

U.S. PATENT DOCUMENTS 4,047,946 9/1977 Croft ..... 430/53
4,120,576 10/1978 Babish ..... 399/116

*Primary Examiner*—Arthur T. Grimley
*Assistant Examiner*—Quana Grainger
*Attorney, Agent, or Firm*—Armstrong, Westerman, Hattori, McLeland & Naughton

[57] ABSTRACT

To provide a photo-sensitive drum having excellent properties which are not at all inferior to those of the prior art photo-sensitive drums assembled with a larger number of parts, capable of being easily manufactured at a reduced production cost. A blank tube 23*d* consisting of a cylinder section 23*a*, a center axis section 23*b* arranged within the cylinder section 23*a* concentrically therewith and a plurality of rib sections 23*c* for rigidly connecting the cylinder section 23*a* with the center axis section 23*b* is integrally formed through extrusion or draw-forming.

4 Claims, 6 Drawing Sheets

PHOTO-SENSITIVE DRUM FORMED FROM EXTRUDED OR DRAWN BLANK AND IMAGE RECORDING APPARATUS HAVING SAME

BACKGROUND OF THE INVENTION

1. Field of the Invention

The present invention relates to a photo-sensitive drum and an image recording apparatus incorporating the same.

2. Description of the Related Art

A photo-sensitive drum is generally used as a static latent image recording medium for an image recording apparatus to which an electronic photographic technology is applied. One example thereof will be explained with reference to FIG. 8. The photo-sensitive drum 83 is assembled with a cylindrical blank tube 85, a pair of disk-like flanges 87 sealingly attached to the opposite ends of the blank tube 85 and a center shaft 89 firmly fitted to center holes of both the flanges 87 while penetrating therethrough.

Since an extremely high dimensional accuracy is required of the blank tube 85 and the center shaft 89 while taking the purpose of the photo-sensitive drum into account, the blank tube 85 and the center shaft 89 are made of aluminum and stainless steel, respectively. The flange 88 is made of resin to reduce weight and cost. To eclectically connect the blank tube 85 with the center shaft 89 for the purpose of grounding, a grounding plate 91 is provided in the interior of the blank tube 85 (photo-sensitive drum 83), which is capable of being in resilient electrical contact with both of the blank tube 85 and the center shaft 89.

According to the prior art structure of a photo-sensitive drum described above, however, there is a problem in that the structure is complicated by requiring a number of parts, which results in increased manufacturing cost and/or assembly cost. For example, it is necessary to manufacture individual parts at a high accuracy and to assemble all of them with each other at a high accuracy, which pushes up the production cost.

SUMMARY OF THE INVENTION

Accordingly, an object of the present invention is to provide a photo-sensitive drum which can be easily manufactured at a lower cost while being not at all inferior to the conventional ones, and an image recording apparatus incorporating the same therein.

To achieve the above object, a photo-sensitive drum is provided according to the present invention, characterized in that a blank tube consisting of a cylinder section, a center axis section arranged within the cylinder section concentrically therewith and a plurality of rib sections for rigidly connecting the cylinder section with the center axis section is integrally formed through extrusion or draw-forming. Preferably, the blank tube is mainly composed of aluminum.

Preferably, a pair of stud members used as a supporting shaft for the photo-sensitive drum are further attached to opposite ends of the center axis section of the blank tube.

An image recording apparatus according to the present invention comprises a photo-sensitive drum formed of a blank tube consisting of a cylinder section, a center axis section arranged within the cylinder section concentrically therewith and a plurality of rib sections for rigidly connecting the cylinder section with the center axis section, wherein the blank tube is integrally formed through extrusion or draw-forming.

As the blank tube of the photo-sensitive drum is integrally formed in a reasonable manner, it is possible to reduce the production cost while maintaining or even improving the quality thereof.

BRIEF DESCRIPTION OF THE DRAWINGS

These and other objects of the present invention will become apparent from the following detailed description of the preferred embodiment of the invention, taken in connection with the accompanying drawings.

In the drawings.

DESCRIPTION OF THE PREFERRED EMBODIMENTS

Preferred embodiments of the present invention will be described below with reference to the attached drawings.

Figure 1:
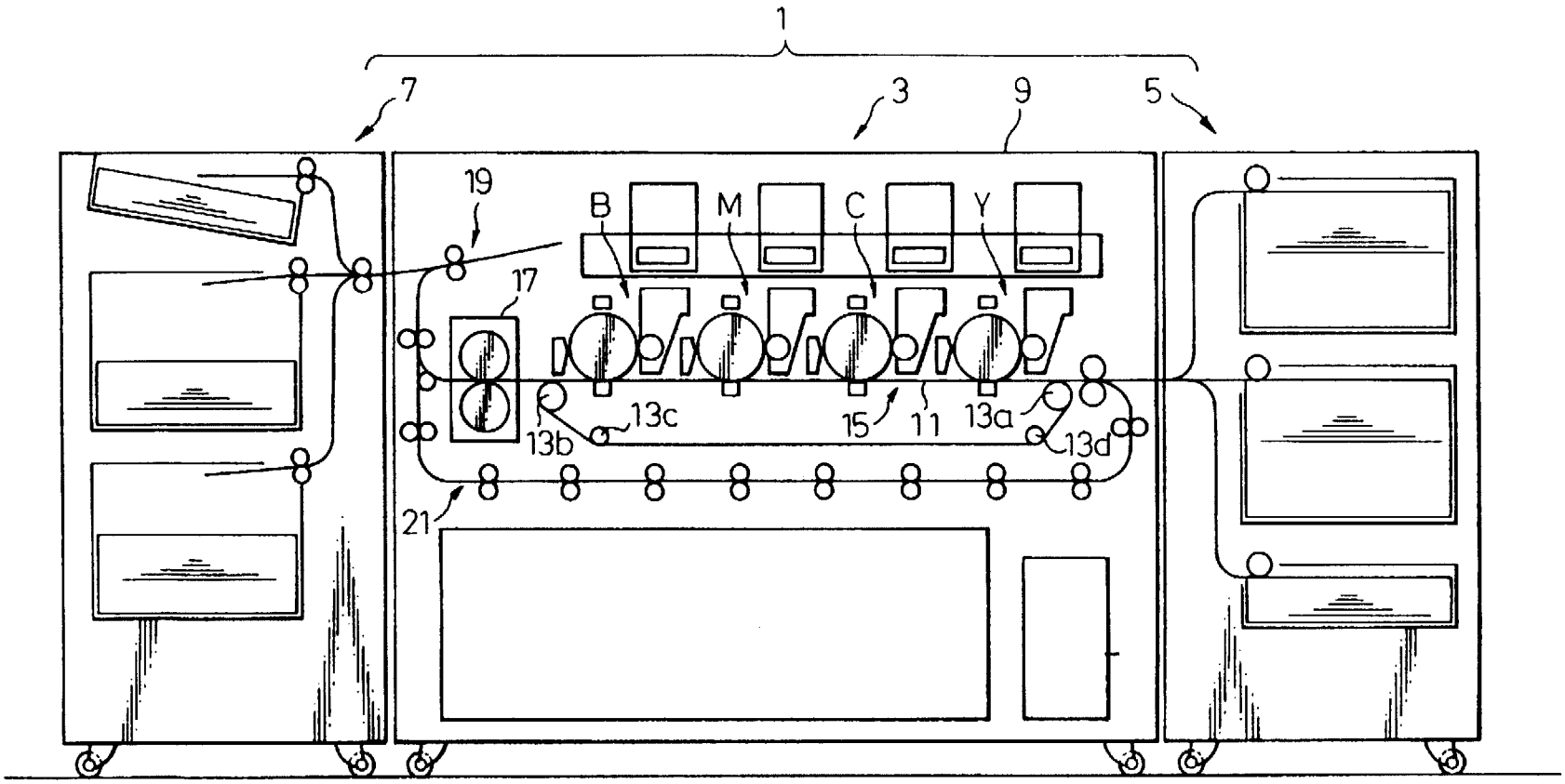
FIG. 1 diagrammatically illustrates the whole structure of one embodiment of a multicolor image recording apparatus incorporating photo-sensitive drums according to the present invention.

FIG. 1 schematically illustrates the whole structure of a multicolor image recording apparatus incorporating photo-sensitive drums according to the present invention. In the drawing, the image recording apparatus 1 basically consists of three box-like zones; a recording zone 3 of a multi-drum type for carrying out full color recording with multiple colors at a high speed, a sheet-feeding zone 5 (right side of FIG. 1) for feeding recording sheets to the recording zone 3, and a delivery zone 7 (left side of FIG. 1) for receiving the recorded sheets delivered from the recording zone 3. The sheet-feeding zone 5 has three sheet cassettes arranged so that one is above the other, in each of which is stored a stack of sheets of a single size. The delivery zone 7 has three delivery trays arranged so that one is over the other, in each of which is stored a stack of recorded sheets.

The recording zone 3 is adapted to minimize the installation area (projected area) thereof by reducing its overall dimensions, so that the office space can be effectively used. That is, the recording zone 3 includes a main frame 9 and four image-forming units Y, C, M and B of substantially the same structure accommodated within the main frame, for recording a yellow toner image, a cyan toner image, a magenta toner image and a black toner image, respectively, on the recording sheet. These image-forming units are arranged parallel to each other at a predetermined distance therebetween in a horizontal plane defined at a middle position of the main frame 9. At a position in the main frame 9 distant downward from the image-forming units are arranged a conveyor device 15 consisting of an endless belt 11 made of resin capable of electro-statically attracting the sheet and four rollers 13*a* through 13*d*, around which is wrapped the endless belt 11. On the downstream side of the conveyor device 15, a fixing device 17 is provided fox thermally fixing the transferred toner images on the recording sheet passing through a transfer process. On the downstream side of the fixing device 17, a delivery device 19 (which is composed of a plurality of roller pairs for nipping and conveying the recorded sheet) is provided for transferring the recorded sheet to the delivery zone 7. To carry out double-sided recording, a reversing device 21 (which is composed of a plurality of roller pairs) is coupled to the delivery device 19, for returning the recording sheet passing through the image-forming units upstream while reversing the same upside-down by using a switch-back system.

Figure 2:
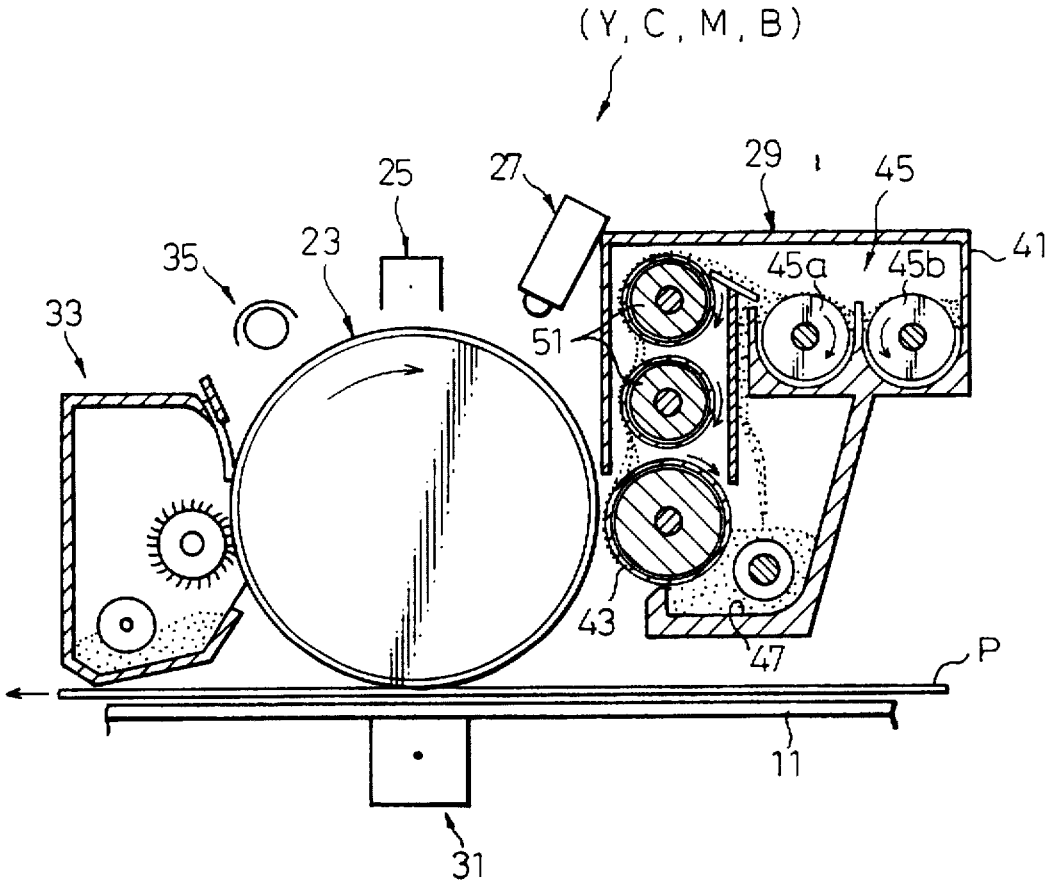
FIG. 2 is a sectional view schematically illustrating an individual image-forming unit.

As shown in FIG. 2, which is a schematic illustration of the individual image-forming units, the respective image-forming units Y, C, M or B include a photo-sensitive drum 23, a precharging device 25 (such as a corona charger, a scorotron charger, a conductive roller type charger or a conductive brush type charger), an optical writing device 27 (such as a laser beam scanner, an LED array or liquid crystal shutter array), a developing device 29, a transfer device 31 (such as a conductive transfer roller), a cleaning device 33 for removing residual toner on the photo-sensitive drum, and a decharger lamp device 35 for decharging the photo-sensitive drum 23.

The respective developing device 29 includes a developer container 41, a developing roller 43 partially exposed from the developer container 41 and disposed opposite to the photo-sensitive drum 23 so that a magnetic brush is formed on the outer periphery thereof, an agitator 45 consisting of a pair of conveyor rollers 45*a*, 45*b* having an agitating/conveying screw blade (not shown in detail) for frictionally charging a toner component and a magnetic carrier component of a bi-component developer and disposed parallel to the developing roller 43, a developer reservoir 47 for receiving the developer overflowing from the agitator 45, a paddle roller 49 for supplying the developer in the developer reservoir 47 to the developing roller 43, and a pair of magnetic rollers 51 for raising the developer exiting from the developing zone (having an exhausted toner component) upward to the agitator 45. Developers containing, respectively, a yellow toner component, a cyan toner component, a magenta toner component and a black toner component are suitably supplied from the respective toner tanks (not shown) to the respective developing devices 29.

The operation of the recording zone 3 will be explained with reference to FIG. 2. A surface of the photo-sensitive drum 23 is sequentially and uniformly charged by the precharger 25 to form a charged area wherein an electro-static latent image is then formed by the optical writing device 27. The electro-static latent image on the photo-sensitive drum 23 is developed in an electro-static manner by the developing device 29 as a charged toner image which is then transferred to a recording sheet (recording medium) P fed from the sheet-feeding zone 5 (see FIG. 1) onto the endless belt 11 by the transfer device 31. A yellow toner image, a cyan toner image, a magenta toner image and a black toner image are sequentially transferred onto the recording sheet as the same sequentially passes through the four image-forming units Y, C, M and B. Since the four color-toner images overlap with each other or a plurality of different color dots are formed in a predetermined area, a multicolor image can be formed, which consists of a number of different colors greater than the number of image-forming units. Thereafter, the recorded sheet P is fed to the fixing device 17 (see FIG. 1) so that the full color image is thermally fixed thereon.

Accordingly, if the toner images do not positionally coincide with each other, the overlapped positions or the dot positions are discrepant from each other, and form colors different from the expected ones. To solve such a problem, it is necessary to manufacture and/or assemble an apparatus for carrying out multicolor printing at a higher accuracy than required for an apparatus for carrying out monochrome printing.

Figure 3:
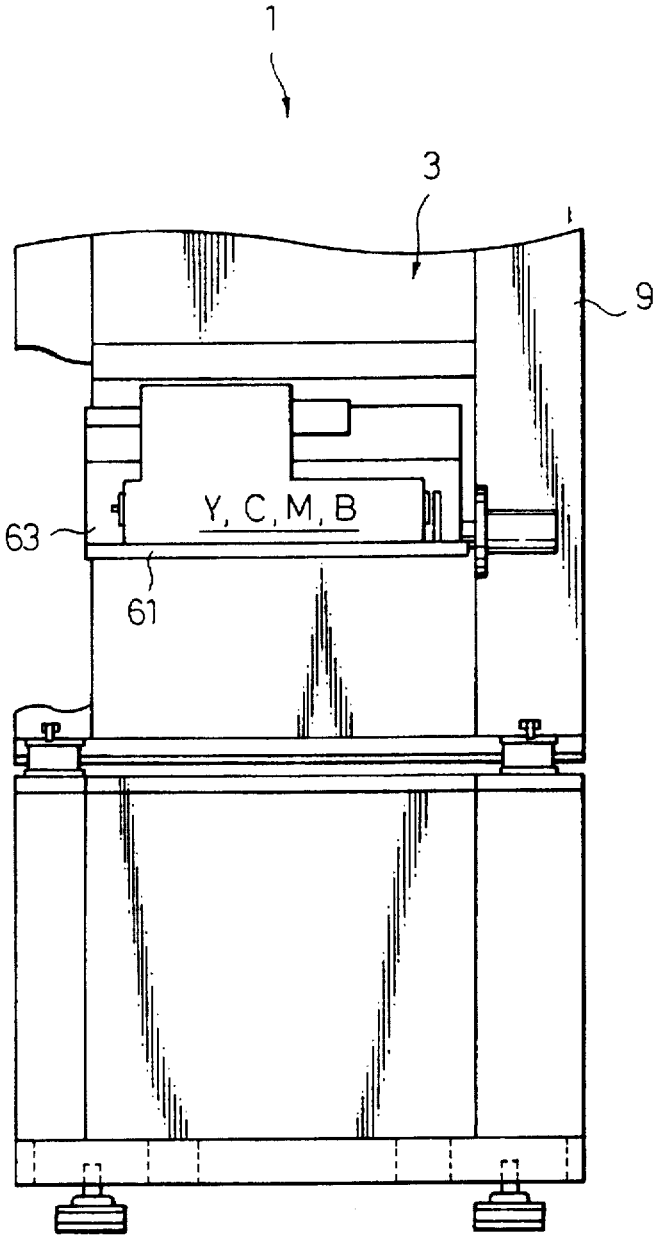
FIG. 3 illustrates a state of the image-forming unit accommodated in the recording zone, as seen on the sheet-feeding zone side.
Figure 4:
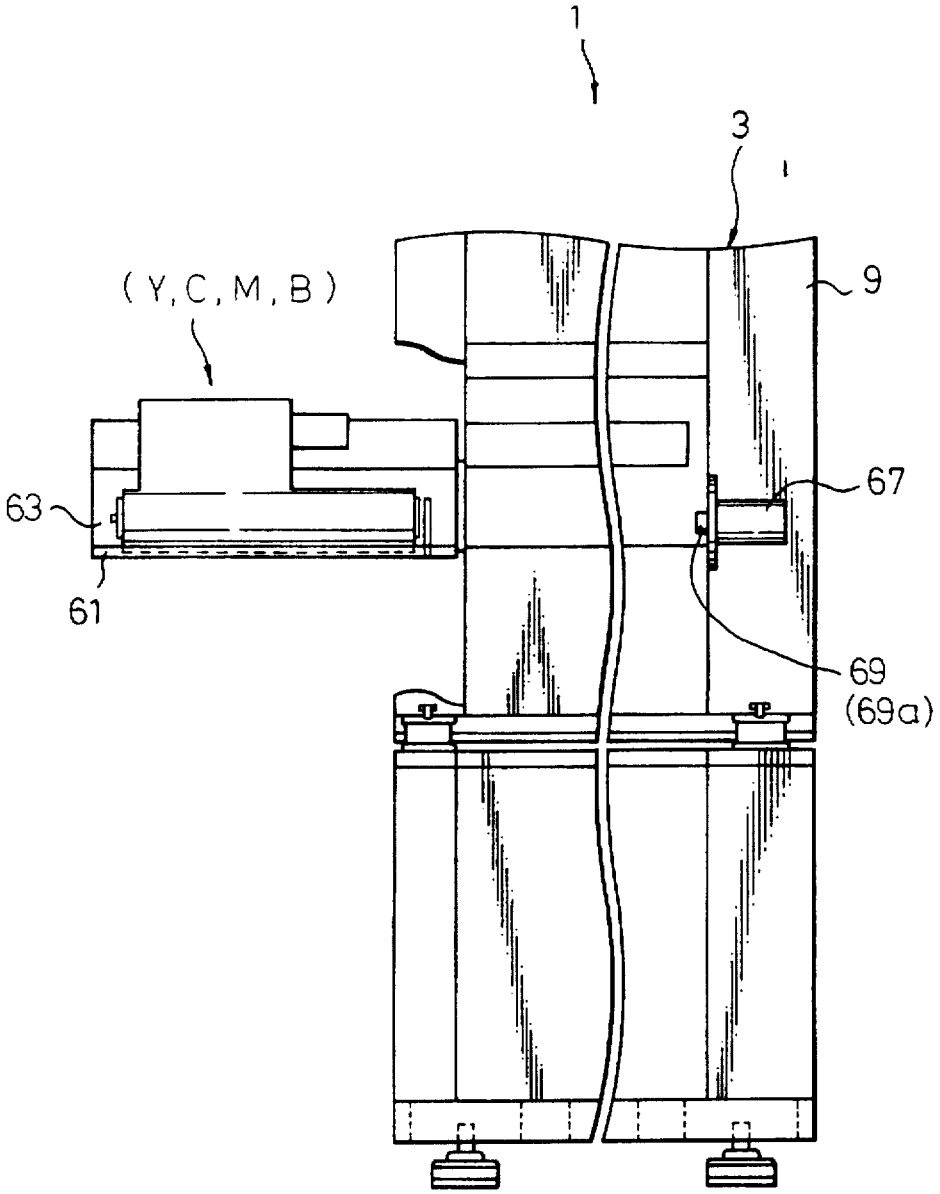
FIG. 4 illustrates a state of the image-forming unit drawn out from the apparatus, as seen on the sheet-feeding zone side.
Figure 5:
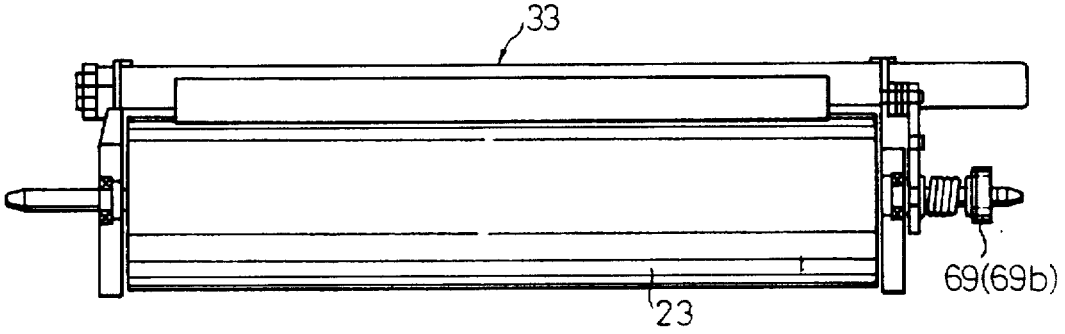
FIG. 5 is a plan view of the photo-sensitive drum removed.

Guiding mechanisms (not shown) are provided on both sides of the main frame 9 of the recording zone 3, through which a subframe 61 (not shown in detail) can be drawn out to the operator side. The four image-forming units Y, C, M and B are mounted onto the subframe 61 so that all the four units can be simultaneously drawn out of the apparatus. Also, each of the image-forming units is mounted onto a slide frame 63 slidably carried on the subframe 61 to be capable of being individually drawn out to the operator side. FIG. 3 shows a state wherein all of the image-forming units Y, C, M and B are accommodated within the apparatus, and FIG. 4 shows a state wherein at least one of the image-forming units is drawn out to the operator side. FIG. 5 shows the photo-sensitive drum 23 removed from the withdrawn image-forming drum, to which is integrally attached the cleaning device 33, or others. When the image-forming unit is accommodated within the interior of the apparatus as shown in FIG. 3, an operator side shaft end (righthand end in FIG. 5) is rotatably supported by a bearing (not shown) provided on the slide frame 63, while the opposite side shaft end is coupled to an output shaft of a drive motor 67 provided on the main frame 9 via a coupling device 69 (69*a*, 69*b*), whereby the photo-sensitive drum 23 is accurately driven to rotate while being positioned at a high precision. On the other hand, when the image-forming unit is drawn out via the slide frame 63, as shown in FIG. 4, the operator side shaft end of the photo-sensitive drum 23 is held by the slide frame 63 as it is, while the opposite shaft end is released from the coupling to the output shaft of the drive motor 69, which, instead, is held by a supporting portion (not shown) of the slide frame 63 directly or indirectly in a relatively rough manner. The photo-sensitive drum 23 can be readily removed in this latter state. As stated above, since the image-forming units Y, C, M and B can be drawn out, it is possible to easily and quickly carry out maintenance, such as the replacement of parts, which eases the operator's work to a great extent.

Figure 6:
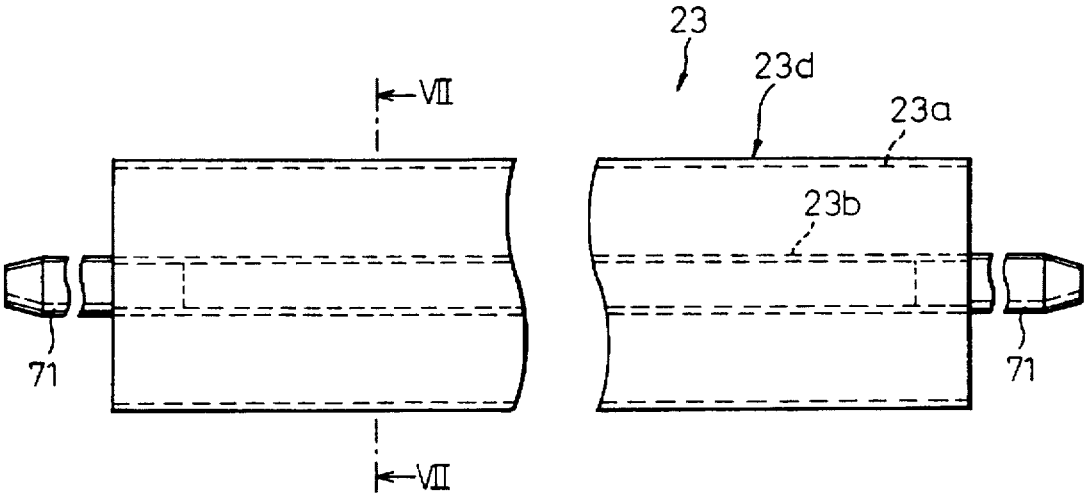
FIG. 6 is a side view of the individual photo-sensitive drum for illustrating the interior structure thereof.
Figure 7:
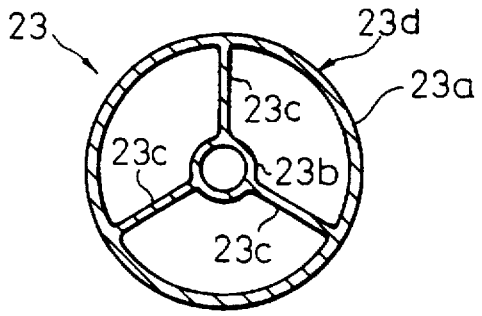
FIG. 7 is a cross-sectional view taken along line VII—VII in FIG. 6.
Figure 8:
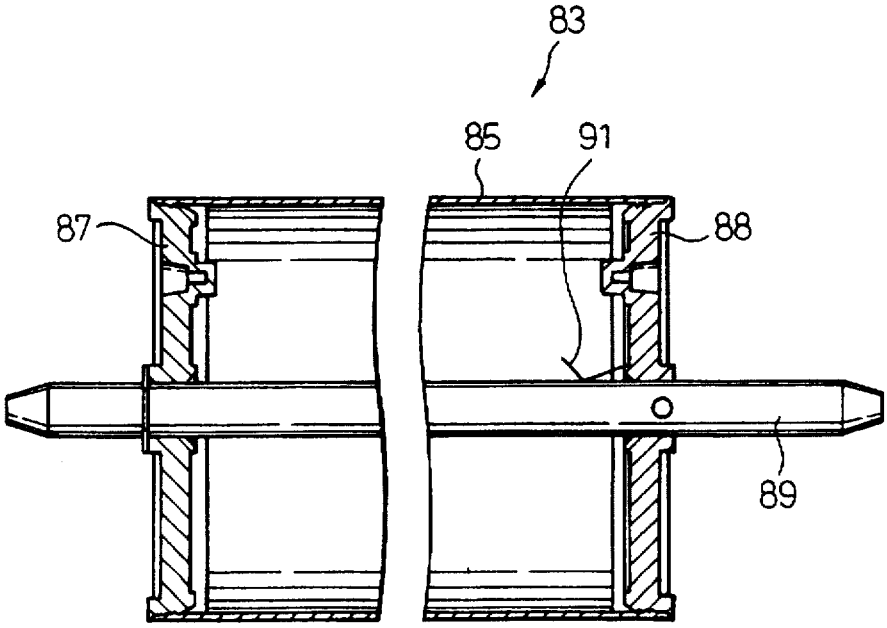
Fig.8 PRIOR ART
FIG. 8 is a longitudinal sectional view of a conventional photo-sensitive drum.

As shown in FIGS. 6 and 7, the photo-sensitive drum 23 constituting a main part of the image-forming unit Y, C, M or B is mainly comprised of a blank tube 23*d* consisting of a cylinder section 23*a*, a hollow center axis section 23*b* disposed within the cylinder section 23*a* concentrically therewith, and three rib sections 23*c* integrally connecting the cylinder section 23*a* with the center axis section 23*b*. The blank tube 23*d* is formed by extrusion (or draw-forming) of a cylindrical rod-like workpiece of aluminum. After the blank has been formed, a pair of stud members 71, for example, of aluminum are press-fit into the opposite ends of the center axis section 23*b* of the blank tube 23*d* so that a supporting shaft for the photo-sensitive drum is formed. A photo-sensitive agent necessary for forming the electro-static latent image by the optical writing device, such as Se, CdS, ZnO, a-Si or OPC (organic photoconductor), of which OPC is preferable, is coated on the surface of the blank tube. Generally, the coating of the photo-sensitive agent (OPC) is carried out by the dip method wherein the blank tube is dipped into the photo-sensitive agent in a tank while one of the stud members of the blank tube is gripped. At that time, the photo-sensitive agent is inevitably stuck to the other stud member. While it is possible to remove the same during the post process, a method is adopted in this embodiment, wherein the portion to which the photo-sensitive agent should be prevented from sticking is preliminarily covered with a masking tape which is removed after the photo-sensitive agent has been coated. In this regard, for the purpose of correcting the oscillation of the surface of the blank tube and achieving a higher accuracy in the circularity and linearity thereof, the outer periphery of the blank tube may be machined, after the stud members 71 have been press-fit, by a lathe, or the like, while rotating the blank tube on the stud members 71, or, alternatively, the outer periphery of the stud members can be machined while rotating the blank tube on the axis thereof. By this method, the distance between the center axis of the stud members 71 and the outer periphery of the blank tube becomes accurately uniform, whereby it is possible to mitigate or eliminate the shear in printing when such photo-sensitive drums are used for a multicolor image recording apparatus.

Instead of using the separate stud members 71, the following may be possible, wherein a blank tube with a solid, not hollow, center axis section **23*b* is formed through the extrusion or draw-forming in a similar manner as the above embodiment, and the opposite end portions of a cylinder section 23*a* and rib sections 23*c* are cut off by a predetermined length while maintaining the center axis section 23*b* to project the opposite ends thereof outward from the cylinder section 23*a* so that the projected portions can be used as a supporting shaft for the photo-sensitive drum. Thereby, since the stud members 71** can be formed together with the blank tube, it is possible to reduce the number of parts, and thus the production cost, a well as to effectively carry out the earthing.

According to the production technology for a photo-sensitive drum stated above, it is possible to easily manufacture a photo-sensitive drum with a higher accuracy which is not at all inferior to conventional ones at a lower cost. In other words, according to the photo-sensitive drum of the present invention, no grounding plate is necessary and the number of parts is reduced to a large extent, resulting in a significant improvement in the production cost.

As described hereinabove, according to the present invention, it is possible to obtain a photo-sensitive drum simple in structure and excellent in quality by a mass-production system at a lower cost. Also, an image recording apparatus incorporating this photo-sensitive drum therein has improved quality and can be manufactured at a lower production cost.

It is to be understood that the invention is by no means limited to the specific embodiments illustrated and described herein, and that various modifications thereof may be made which come within the scope of the present invention as defined in the appended claims.

We claim:

1. A photo-sensitive drum characterized by a blank tube comprising:

a hollow cylinder section;

a center axis section arranged within the hollow cylinder section concentrically therewith; and a plurality of radially extending rib sections extending substantially parallel to said hollow cylinder section and said center axis section rigidly interconnecting the cylinder section and the center axis section;

at least said center axis section having a length which is not substantially less than the length of said cylinder section; and wherein said cylinder section, said center axis section and said rib sections forming said blank tube are all integrally formed through extrusion or draw-forming.

2. A photo-sensitive drum, as defined by claim 1, in which said blank tube is mainly composed of aluminum.

3. A photo-sensitive drum, as defined by claim 1, including a pair of stud members used as a supporting shaft for the photo-sensitive drum attached to opposite ends of the center axis section of the blank tube.

4. An image recording apparatus comprising a photo-sensitive drum formed of a blank tube comprising a hollow cylinder section, a center axis section arranged within the cylinder section concentrically therewith, and a plurality of rib sections for rigidly interconnecting the cylinder section and the axis section, said center axis section having a length which is not substantially less than the length of said hollow cylinder section; and wherein the cylinder section, the center axis section and the rib sections forming the blank tube are integrally formed through extrusion or draw-forming.

* * * * *